US006750401B2

(12) United States Patent
Vokey

(10) Patent No.: US 6,750,401 B2
(45) Date of Patent: Jun. 15, 2004

(54) TRACE WIRE FOR TRANSMISSION OF A TONE FOR LOCATING UNDERGROUND UTILITIES AND CABLES

(76) Inventor: David E. Vokey, 1206 Northwind Cir., Bellingham, WA (US) 98226

( * ) Notice: Subject to any disclaimer, the term of this patent is extended or adjusted under 35 U.S.C. 154(b) by 0 days.

(21) Appl. No.: 10/193,248

(22) Filed: Jul. 12, 2002

(65) Prior Publication Data

US 2004/0007381 A1 Jan. 15, 2004

(51) Int. Cl.[7] ..... H01B 7/02
(52) U.S. Cl. ..... 174/120 R; 174/110 F
(58) Field of Search ..... 174/110 F, 120 R

(56) References Cited

U.S. PATENT DOCUMENTS 3,516,859 A * 6/1970 Gerland et al. ..... 427/118

* cited by examiner

*Primary Examiner*—Chau N. Nguyen

(57) ABSTRACT

A trace wire is placed alongside an underground utility for long distance transmission of locating tones. The trace wire has a conductive core. There is an electrically insulating sheath on the core. The sheath has an inner layer in the form of a solid foam of dielectric material. An outer layer of the sheath is a solid dielectric material surrounding the inner layer. This combination of a core conductor with insulating materials in a multi-layered design provides significantly improved properties over current commercially available insulated conductors when used as trace wires. In the presently preferred embodiment of the invention, the trace wire construction includes a 1.6 mm (14 AWG) hard drawn copper conductor to provide low resistance along with high break strength. The inner layer of the sheath is gas injected foamed polyethylene (PE) insulation applied to an overall diameter of 7 mm. The outer layer is solid, medium or high density PE applied over the first layer to an over all outer diameter of 8.5 mm. This dual-layer insulation exhibits an effective relative dielectric constant of about 1.6. The attenuation constant at 500 Hz is 0.227 dB per km maximum. The break strength is about 135 kg and the trace wire is light weight at about 60 kg per km.

9 Claims, 2 Drawing Sheets

TRACE WIRE FOR TRANSMISSION OF A TONE FOR LOCATING UNDERGROUND UTILITIES AND CABLES

FIELD OF THE INVENTION

The present invention relates to locating underground cables, pipes and utilities, and more particularly to a trace wire that is used to carry a locating tone which is detected by a hand-held receiver thereby pinpointing the precise location of the underground utility.

BACKGROUND OF THE INVENTION

Buried underground, particularly in the modem urban environment, is a virtual maze of utilities. These include telephone, electricity, gas, cable television, fibre optics, traffic signals, street lighting circuits, drainage and flood control facilities, water mains, and waste water pipes. Frequently, they are buried in close proximity to one another and are susceptible to damage due to construction equipment excavating in their vicinity.

The clear identification and location of the underground utilities is of the utmost importance to avoid dig-ups and damage. However, the records are often poor with inaccurate utility locations and depths. Some lines are not even recorded.

A trace wire is often placed in a duct or buried directly along with the utility in an attempt to provide a means for locating the utility prior to excavation in the area. The utility is located by transmitting a locating tone on the trace wire. A special receiver with magnetic field detecting coils is used to sense the tone current travelling along the trace wire. By this means the path and depth of the trace wire, and therefore the utility may be determined.

Typical trace wires used range from commercially available PVC insulated building wire to marker tapes with integral tracing wire. In practice, the trace wires used are often less than adequate. The standard commercial grade wire is not well suited for this application. The smaller gage wires often break or are damaged and present a high attenuation to the tone signal, which limits the useful locate distance. Larger gauge conductors, such as an insulated #6 AWG, have been used to lower the attenuation rate in an effort to reach greater distances. This improvement is offset by an increase in size and weight, which degrades the blow-in and pull-in performance in duct installations. In particular, good blow-in performance requires a light weight and good rigidity to prevent buckling during the installation.

The present invention makes use of a unique combination of insulation materials and conductors to achieve optimum results for the trace wire application.

SUMMARY OF THE INVENTION

According to the present invention, there is provided a trace wire to be placed alongside an underground utility for long distance transmission of locating tones, said trace wire comprising:

a conductive core;

an electrically insulating sheath on the core, said sheath comprising:

an inner layer comprising a solid foam of dielectric material in contact with and symmetrically distributed about the core;

an outer layer of solid dielectric material surrounding the inner layer.

The trace wire may be used with underground utilities of any type, for example cables, pipes and ducts.

The use of this combination of a core conductor with insulating materials in a multi-layered design provides significantly improved properties over current commercially available insulated conductors when used as trace wires.

In the presently preferred embodiment of the invention, the trace wire construction includes a. 1.6 mm (14 AWG) hard drawn copper conductor to provide low resistance along with high break strength. The inner layer of the sheath is gas injected foamed polyethylene (PE) insulation applied to an overall diameter of 7 mm. The outer layer is solid, medium or high density PE applied over the first layer to an over all outer diameter of 8.5 mm. This dual-layer insulation exhibits an effective relative dielectric constant of about 1.6. The attenuation constant at 500 Hz is 0.227 dB per km maximum. The break strength is about 135 kg and the trace wire is light weight at about 60 kg per km.

BRIEF DESCRIPTION OF THE DRAWINGS

In the accompanying drawings, which illustrate an exemplary embodiment of the present invention.

DETAILED DESCRIPTION OF THE PREFERRED EMBODIMENTS

Before referring in detail to the drawings, it will be useful to consider the preferred characteristics of a trace wire, both electrical and mechanical.

Preferred Performance Requirements

An optimum trace wire should incorporate several key features:

1. The structure should be mechanically rigid to prevent buckling and folding back on itself during blow-in installation in a typical underground plastic duct.

2. The outer layer of the trace wire should be composed of a smooth, rugged insulating material to provide a low coefficient of friction and withstand installation abrasion.

3. The over-all structure should have high tensile strength to facilitate long length pull-in in underground ducts.

4. To ensure maximum locate distance and accurate locates, the trace wire should exhibit low loss characteristics at the tone locating frequencies of interest.

Flexural Rigidity

The insulating layer formed over the trace wire conductor can contribute considerably to the flexural rigidity. For an insulating layer over a conductor the flexural rigidity is given by:

$$F_r = E\pi(D^4 - d^4)/64 \quad (1)$$

where: D is the outer diameter of the insulation;

d is the inner diameter of the insulation;

E is the modulus of elasticity of the material;

For a typical insulated conductor d would be the outer diameter of the conductor.

The total cross-sectional area of the insulation is given by:

$$A=\pi(D^2-d^2)/4 \quad (2)$$

The insulating layer forms a cylindrical tube over the conductor. Considering the case for a fixed cross-sectional area A of an insulating material the insulation can be applied such that the inner surface of the tube is in tight contact with the conductor. This results in an outer diameter of $D_a$,. Applying the same cross sectional area A of the material, while allowing the outer diameter of the insulation to increase, results a tube with a thinner wall thickness and larger outer diameter $D_b$.

Figure 1A:
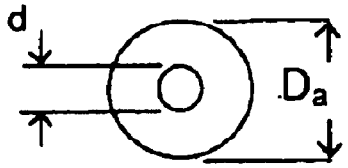
FIG. 1*a* is a cross-section of an insulated conductor with one layer of insulation material.
Figure 1B:
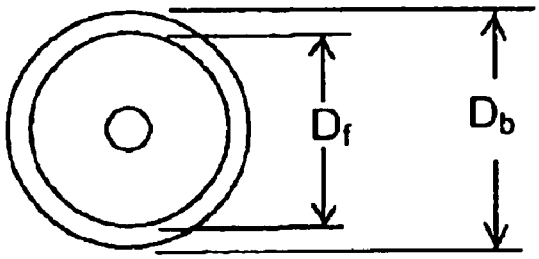
FIG. 1*b* is a cross-section of a conductor like that of FIG. 1 with a layer of insulation material having a larger external diameter and the same cross-sectional area as the insulation in FIG. 1.
Figure 2:
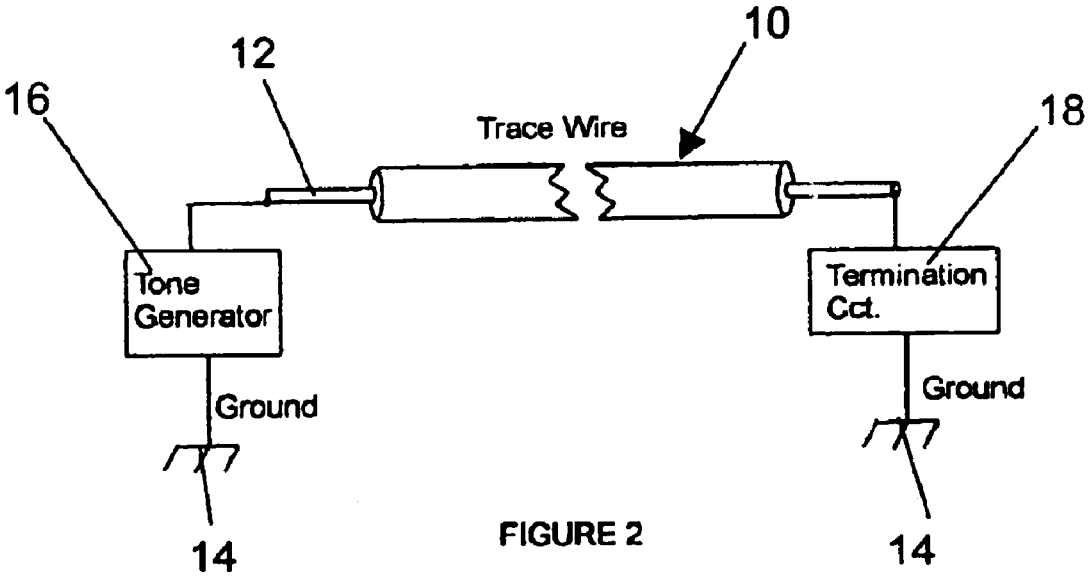
FIG. 2 illustrates a tracing system using a tone generator, a trace wire and a termination circuit connected in a ground return configuration.

For these two cases, as shown in FIG. 1*a* and 1*b*, the ratio of flexural rigidity for two outer insulation diameters is given by:

$$F_{ra}/F_{rb} = (D_a^2 - 2A/\pi)/(D_b^2 - 2A/\pi) \quad (3)$$

where: $D_a$ is the minimum outer diameter where the insulation contacts the conductor $D_b$ is the larger outer diameter of the insulation spaced from the conductor.

Figure 3:
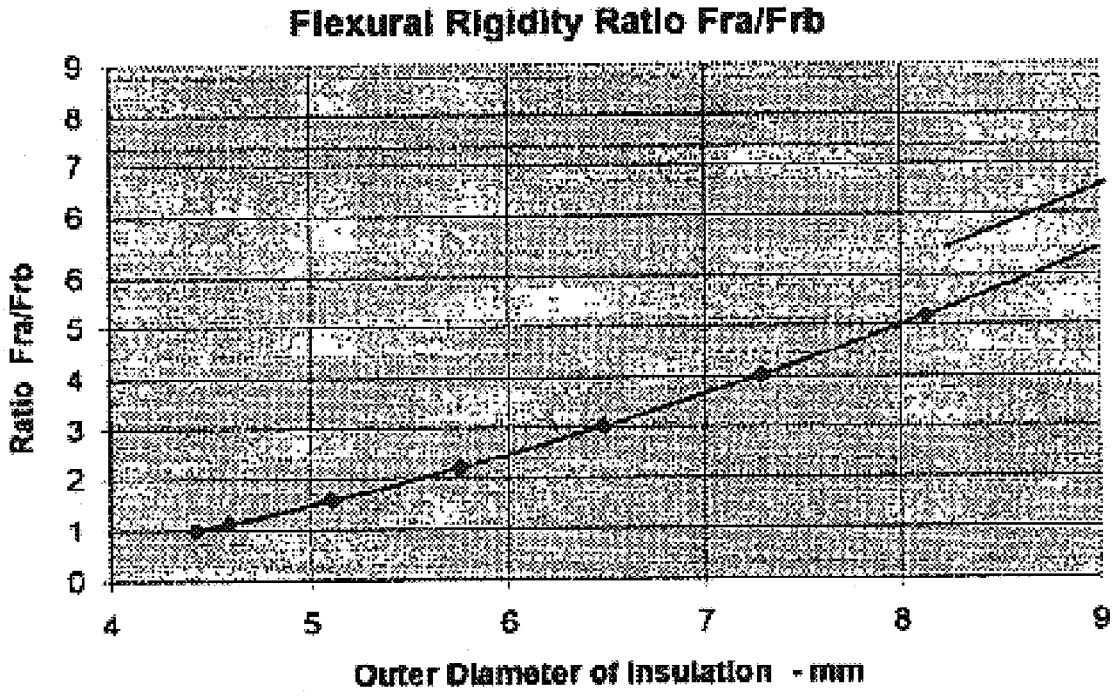
FIG. 3 is a graph illustrating the ratio of flexural rigidity for a fixed cross-sectional area and varying outer diameter.

As can be seen in Equation (3) and as illustrated in FIG. 3, the increase in flexural rigidity grows approximately as the ratio of the squares of the outer diameters. This implies that, for a given amount of insulating material, a more rigid cylindrical structure is realized by increasing the outer diameter while allowing the wall thickness to decrease. The rigidity increases without increasing the amount and therefore weight of insulating material.

With a fixed cross-sectional area, as the outer diameter is increased, the inner diameter will increase and will exceed the diameter of the conductor. This results in the conductor fitting loosely in the insulation. For good electrical and mechanical performance, it is important to maintain the conductor in the centre of the insulating structure and mechanically coupled to the insulation.

Tensile Strength

High tensile strength is required to allow long length pull-in capability. The conductor and the outer layer of insulating material provide the tensile strength. The modulus of elasticity of the solid insulation should be as high as possible to enhance both structural rigidity and tensile strength. To ensure low series resistance, the conductor will typically be made of solid copper. The solid copper conductor should be hard drawn (HD). HD copper is more rigid and has break strength approximately twice that of annealed copper. This adds greatly to both the rigidity and pull-in performance of the design.

Analysis of the Trace Wire as a Transmission Line

Figure 4:
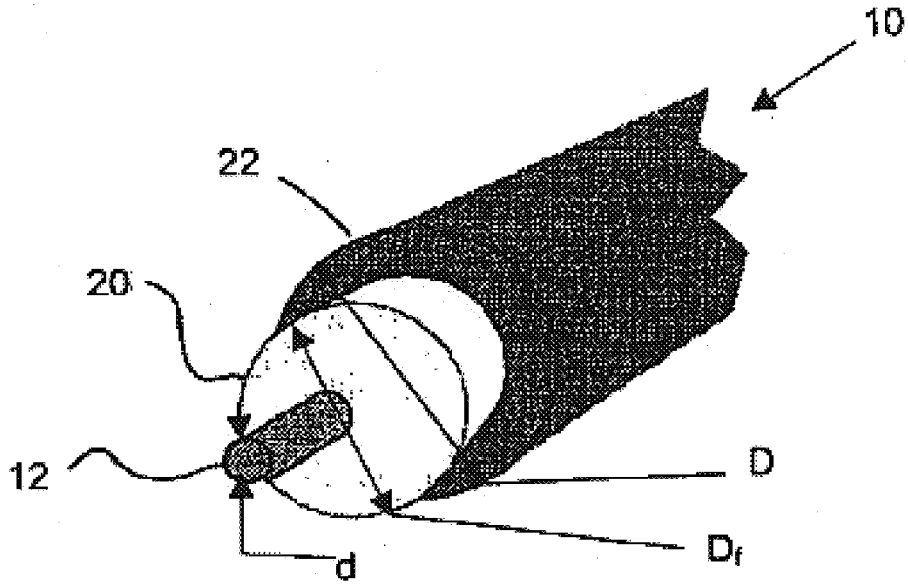
FIG. 4 is an isometric illustration of a multi-layered trace wire.

The trace wire 10 can be considered a form of coaxial transmission line with the copper conductor 12 as the inner conductor and earth (ground 14) as the outer conductor as shown in FIG. 4. A signal tone is applied to one end of the core conductor 12 by a tone generator 16. The opposite end of the conductor is connected to ground by a termination circuit 18 which controls, either passively or actively, the current in the wire.

At frequencies of a few kilohertz or less the attenuation of the transmission line is closely approximated by:

$$\alpha=8.686(\pi fRC)^{1/2} \text{ db/km} \quad (4)$$

where: f is the frequency in cycles per second

R is the armour or shield resistance per km

C s the wire capacitance to ground per km

To maximize the tracing distance, the attenuation should be made as small as possible. As seen in equation (4), this is accomplished by decreasing the series resistance, the capacitance to ground or both. Reducing the series resistance requires an increase in the wire diameter thereby increasing the weight and cost of the trace wire. Reducing the capacitance to ground can be achieved by increasing the insulation thickness but this also can add significantly to the weight and cost.

A more effective means to reduce the capacitance to ground is to reduce the dielectric constant. This can be accomplished by foaming the insulation material by injecting an inert gas during the insulation process. However, the solid foam insulation has a much lower modulus of elasticity and exhibits low structural rigidity.

The present design employs a layered insulation. For an insulated conductor covered by two layers of insulation the capacitance to ground is given by:

$$Ct = 0.0555 * k_f * k_s \Big/ \left[k_f * \ln\left[\frac{D}{D_f}\right] + k_s * \ln(D_f/d)\right] \ \mu\text{F/meter} \quad (5)$$

where: D is the diameter of the second layer of insulation $D_f$ is the diameter of the first layer of insulation $K_s$ is the relative dielectric constant of the second layer of insulation $K_f$ is the relative dielectric constant of the first layer of insulation d is the conductor diameter Trace Wire Design Details Referring to FIG. 4 of the drawings, a hard drawn copper conductor 12 is used to maximize tensile strength and rigidity of the conducting element. For the presently preferred design as illustrated, a copper conductor of 1.6 mm (14 AWG) diameter is used. The break strength of the insulated wire with HD copper is nearly 135 kg, which provides excellent pull-in performance.

The conductor is insulated to an overall diameter of 7 mm with a solid foam polyethylene 20 foamed by gas injection to a level of approximately 50% polyethylene and 50% inert gas. This increases the overall diameter without significantly increasing the weight and reduces the combined relative dielectric constant to about 1.6 from 2.3 for solid insulation.

The present invention provides increased flexural rigidity for a fixed volume of solid insulating material by not constraining the inner diameter of the solid insulation while tightly capturing the conductor in the centre of the structure.

A solid insulating material 22 for example high or medium density polyethylene is extruded over the foam insulation to an overall diameter of 8.5 mm. This adds greatly to the flexural rigidity and abrasion resistance. For the solid insulation layer with an outer diameter of 8.5 mm and inner diameter of 7 mm the cross sectional area of insulation is 18.25 $mm^2$. Applying the same amount of insulation directly over the 1.6 mm conductor would result in an outer diameter of 5.08 mm. Therefore, from equation (1) with the cross sectional area of insulating material held constant, the flexural rigidity of the 8.5 mm outer diameter relative to the 5.08 mm diameter is greater by a factor of factor of 5.9.

The dual insulated layer design results in a coaxial capacitance of about 0.052 F per km. A similar conductor with a single layer of solid insulation would exhibit a coaxial capacitance of about 0.077 F per km. From equation (4) the attenuation at a locate frequency of 500 Hz is 0.227 dB/km for the dual layer insulation and 0.273 dB/km for the single layer insulation. A typical cable locate system has a dynamic range of about 30 dB. This calculates to a locate distance of 110 km for the single layer design and 132 km for the dual layer design which is a 20% improvement in locate distance.

Thus, by employing a unique combination of conductors and insulating materials a trace wire design has been realized which has superior tensile strength, flexural rigidity, abrasion resistance combined with light weight and, low attenuation. This results in excellent installation properties and extended tracing distances.

While specific reference has been made in the foregoing to a particular, currently preferred embodiment of the invention, it is to be understood that the invention is not limited to that specific embodiment. Other embodiments are possible using other materials and different dimensions, based on the properties of those materials, the intended installation technique and the intended end use of the wire.

What is claimed:

1. A trace wire to be placed alongside an underground utility for long distance transmission of locating tones, said trace wire comprising:

a conductive core comprising a hard drawn copper conductor; and an electrically insulating sheath on the core, said sheath comprising:

an inner layer comprising a solid foam of dielectric material symmetrically distributed about the core; and an outer layer of solid dielectric material surrounding the inner layer; and the conductor comprising a 1.6 mm diameter (14 AWG) hard drawn copper conductor.

2. A trace wire according to claim 1 wherein the inner layer of the sheath is gas injected foamed polyethylene (PE) insulation.

3. A trace wire according to claim 1 wherein the sheath has a dielectric constant of about 1.6.

4. A trace wire according to claim 1 wherein the wire has an attenuation constant of about 0.227 dB/km at 500 Hz.

5. A trace wire according to claim 1 wherein the sheath has a capacitance of about 0.052 $\mu$F per km.

6. A trace wire according to claim 1 wherein the wire has a break strength of about 135 kg.

7. A trace wire according to claim 1 having a weight of about 60 kg per km.

8. A trace wire to be placed alongside an underground utility for long distance transmission of locating tones, said trace wire comprising:

a conductive core comprising a hard drawn copper conductor; and an electrically insulating sheath on the core, said sheath comprising:

an inner layer comprising a solid foam of dielectric material symmetrically distributed about the core; and an outer layer of solid dielectric material surrounding the inner layer; and the inner layer of the sheath comprising solid foam polyethylene (PE) insulation and having an outer diameter of 7 mm.

9. A trace wire to be placed alongside an underground utility for long distance transmission of locating tones, said trace wire comprising:

a conductive core comprising a hard drawn copper conductor; and an electrically insulating sheath on the core, said sheath comprising:

an inner layer comprising a solid foam of dielectric material symmetrically distributed about the core; and an outer layer of solid dielectric material surrounding the inner layer; and the outer layer of the sheath comprising solid polyethylene and having an outer diameter of 8.5 mm.

* * * * *